US007887289B2

(12) United States Patent
Tokunaga et al.

(10) Patent No.: US 7,887,289 B2
(45) Date of Patent: Feb. 15, 2011

(54) BLOWER SYSTEM

(75) Inventors: Taichi Tokunaga, Niigata (JP); Hirotoshi Sato, Shibata (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 711 days.

(21) Appl. No.: 11/830,878

(22) Filed: Jul. 31, 2007

(65) Prior Publication Data

US 2008/0131275 A1 Jun. 5, 2008

(30) Foreign Application Priority Data

Nov. 1, 2006 (JP) ..... 2006-297952

(51) Int. Cl.
*F04D 29/00* (2006.01)

(52) U.S. Cl. ..... 415/206; 415/121.2; 415/229; 417/420; 417/423.7; 417/423.9

(58) Field of Classification Search ..... 415/206, 415/220, 121.2, 229; 416/146 R; 417/420, 417/423.7, 423.9
See application file for complete search history.

(56) References Cited

U.S. PATENT DOCUMENTS 5,075,606 A * 12/1991 Lipman ..... 318/400.08
6,386,839 B1 * 5/2002 Chuang ..... 417/356
6,525,938 B1 * 2/2003 Chen ..... 361/695
6,911,757 B2 * 6/2005 Lopatinsky et al. ..... 310/164
7,207,774 B2 * 4/2007 Kashiwazaki et al. ..... 415/206
7,614,250 B2 * 11/2009 Sanagi ..... 62/426

FOREIGN PATENT DOCUMENTS

JP 2005-113730 4/2005
JP 2005-127311 5/2005

* cited by examiner

*Primary Examiner*—Ninh H Nguyen
(74) *Attorney, Agent, or Firm*—Antonelli, Terry, Stout & Kraus, LLP.

(57) ABSTRACT

The invention provides a blower system of a high performance, which is constructed to have stabilized characteristics, a high efficiency, a reduced thickness and a reduced noise. A blower system according to the invention includes an impeller, a motor for rotating the impeller and having a rotor and a stator, and a bell-mouth for supplying air to an intake port in the impeller, wherein the rotor is fixed to the impeller, and the stator is fixed to the bell-mouth. A gap between the impeller and the bell-mouth is composed of a gap between the rotor and the stator of the motor. Alternatively, the rotor is fixed to the impeller, and the stator is fixed to a fitting for mounting a housing of the blower system or the blower system.

8 Claims, 7 Drawing Sheets

BLOWER SYSTEM

INCORPORATION BY REFERENCE

The present application claims priority from Japanese application JP-2006-297952 filed on Nov. 1, 2006, the content of which is hereby incorporated by reference into this application.

TECHNICAL FIELD

The present invention relates to a blower system, and particularly, to a system intended to blow air, and generally to a system including an air-blowing mechanism.

BACKGROUND OF THE INVENTION

Conventionally, a motor is disposed at a central portion of an impeller, and a section for accommodating the motor is mounted on the impeller, which provides a resistance to the flow-in of air, resulting in a degraded efficiency of the blower system. Although the reduction of the section for accommodating the motor causes a decrease in resistance to the flow-in of air, it results in an increase in height of the entire system. In this way, it is difficult to reconcile the thinning of the entire system and the efficiency of the blower system. Furthermore, a gap exists between the impeller and a bell-mouth, and thus a leakage from the inside of the equipment through the gap to an intake port is necessarily generated. This provides a large influence on the efficiency of the blower system.

It has been proposed in JP-A-2005-113730 and JP-A-2005-127311 to mount a motor between an impeller and a bell-mouth. However, a gap between the impeller and the bell-mouth has not been considered in these applications.

SUMMARY OF THE INVENTION

In the conventional blower system, it is difficult to increase the efficiency of the blower system due to the resistance to the flow-in of air in the section for accommodating the motor and the leakage from the inside of the equipment to the intake port. It is also difficult to thin the entire blower system, because the motor is disposed at the central portion of the impeller.

Even if an attempt is made to thin the entire blower system by thinning the motor, it is difficult to reconcile an increase in efficiency and a reduction in noise, because the section for accommodating the motor exists at the central portion of the impeller.

Accordingly, it is an object of the present invention to provide a blower system having a high performance, and having high efficiency, a reduced thickness, a reduced noise and stabilized properties, by disposing a thin motor around a periphery of a lower portion of an impeller, or by disposing a motor between the impeller and a bell-mouth.

A blower system according to the present invention comprises an impeller, a motor for rotating the impeller, and a bell-mouth for supplying air to an intake port in the impeller. The thin motor is disposed around a periphery of a lower portion of the impeller, so that a section accommodating a motor does not exist at a central portion of the impeller, and thus resistance to the flow-in of air is decreased and efficiency is increased. In addition, since the flowing of air around the lower portion of the impeller is eliminated by disposing the thin motor at the lower portion of the impeller, efficiency is increased.

An aspect of the invention provides a blower system comprising an impeller, a motor for rotating the impeller and having a rotor and a stator, and a bell-mouth for supplying air to an intake port in the impeller, wherein the rotor of the motor is fixed to the impeller, and the stator of the motor is fixed to the bell-mouth.

According to a preferable embodiment, a gap between the impeller and the bell-mouth is composed of a gap between the rotor and the stator of the motor.

Another aspect of the present invention provides a blower system comprising an impeller, a motor for rotating the impeller and having a rotor and a stator, and a bell-mouth for supplying air to an intake port in the impeller, wherein the rotor of the motor is fixed to the impeller, and the stator of the motor is fixed to a fitting for mounting a housing of the blower system or the blower system.

According to a preferable embodiment, the rotor of the motor is annular and fixed to a peripheral portion of the impeller.

Other objects, features and advantages of the invention will become apparent from the following description of the embodiments of the invention taken in conjunction with the accompanying drawings.

DETAILED DESCRIPTION OF THE INVENTION

Embodiments of a blower system according to the present invention will now be described with reference to FIGS. 1 to 10.

Figure 1:
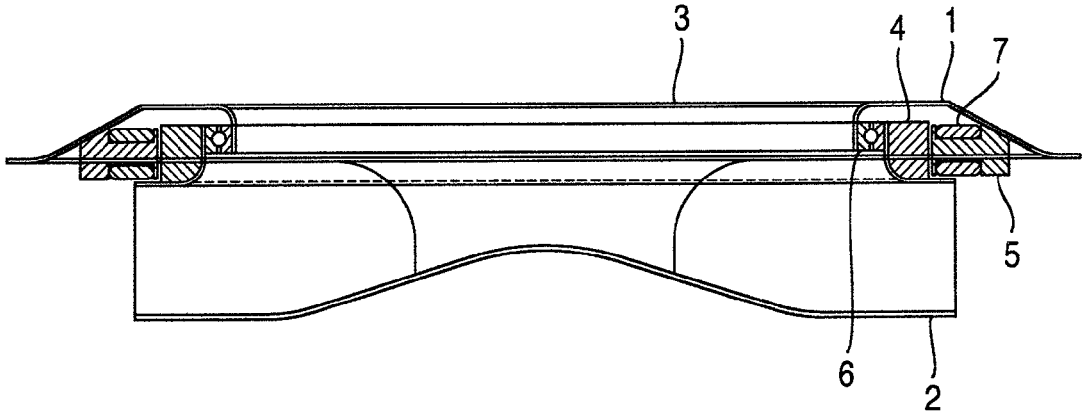
FIG. 1 is a view showing the arrangement of a blower system according to a first embodiment of the present invention.

First, a first embodiment of the present invention will be described. FIG. 1 is a view showing an arrangement of a blower system of this embodiment. As shown in FIG. 1, the blower system of the embodiment comprises a bell-mouth 1, an impeller 2, and a motor for rotating the impeller. The motor is comprised of an annular rotor 4 integrated with the impeller, and a stator 5 fixed to the bell-mouth 1 around a periphery of the rotator 4. The rotor 4 and the stator 5 of the motor confront each other in parallel to a direction of an axis of rotation. The bell-mouth 1 and the impeller 2 are retained by a bearing 6 and adapted to be rotated. Air is drawn through an intake port 3 for blowing.

Figure 2:
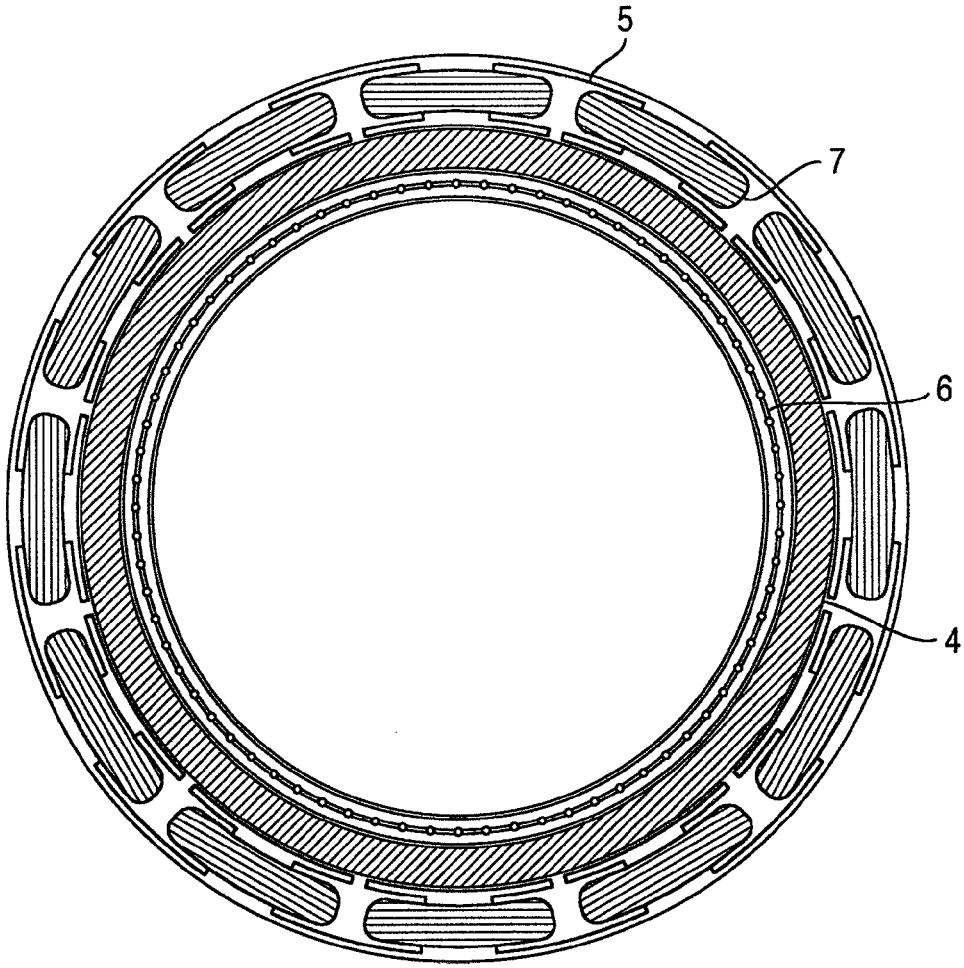
FIG. 2 is a top view of the blower system according to the first embodiment.

FIG. 2 is a top view of the blower system of the embodiment. As shown in FIG. 2, the stator 5 has a coil 7 disposed on its circumference for producing a rotating magnetic field. A torque is generated by the rotating magnetic field produced by the stator 5 to rotate the impeller fixed to the rotor so as to blow air.

Figure 3:
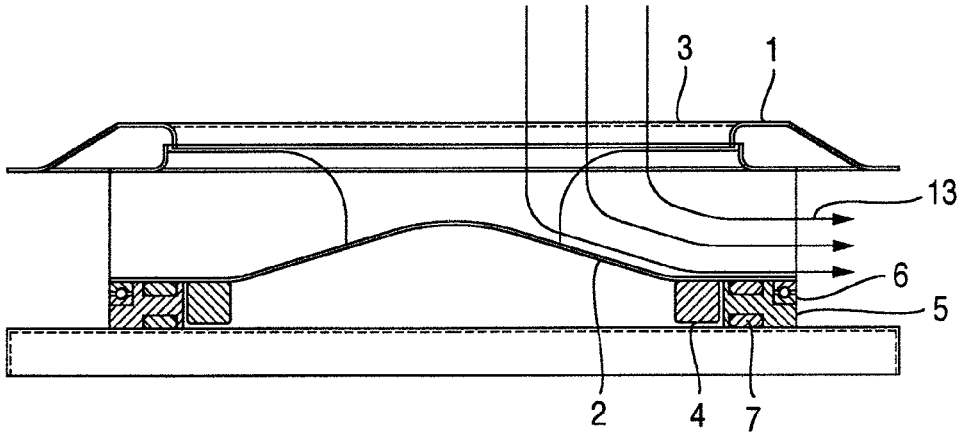
FIG. 3 is a view showing the arrangement of a blower system according to a second embodiment of the present invention.

A second embodiment will be described below. FIG. 3 is a view showing an arrangement of a blower system of this embodiment. As shown in FIG. 3, the blower system of this embodiment comprises a bell-mouth 1, an impeller 2 and a motor for rotating the impeller. The motor is disposed around a periphery of a lower portion of the impeller. A rotor 4 of the motor is fixed to the impeller 2, and a stator 5 is disposed around a periphery of the rotor 4 and fixed to a fitting for mounting a housing of the blower system or the blower system itself. The rotor 4 and the stator 5 of the motor confront each other in parallel to a direction of an axis of rotation. A bearing 6 is disposed between the stator 5 and the impeller 2, so that the impeller 2 can be rotated. Air is drawn through an intake port 3 for blowing.

Figure 4:
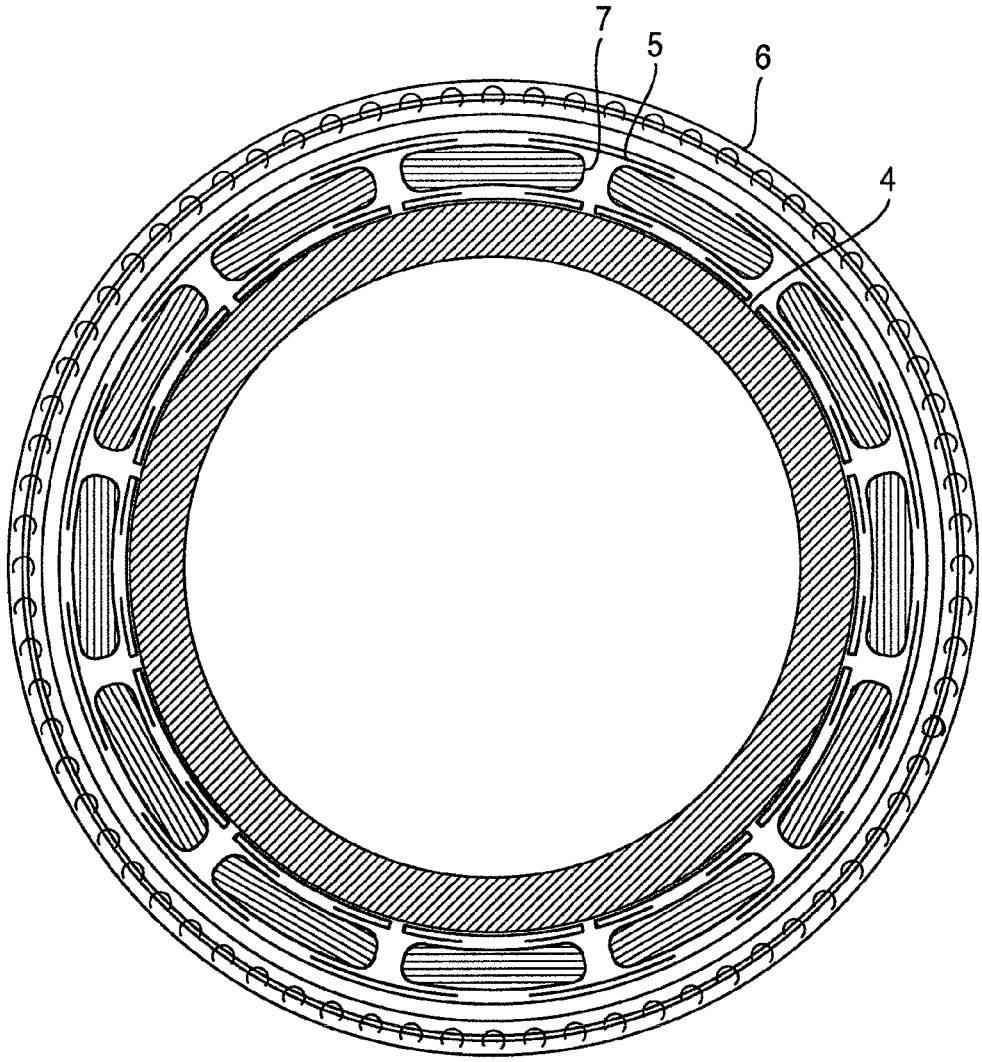
FIG. 4 is a top view of the blower system according to the second embodiment.

FIG. 4 is a top view of a motor region in this embodiment. As shown in FIG. 4, the rotor 4 is disposed, and stators 5 are disposed around a periphery of the rotor 4. Bearings 6 are disposed around outer peripheries of the stators 5.

Figure 5:
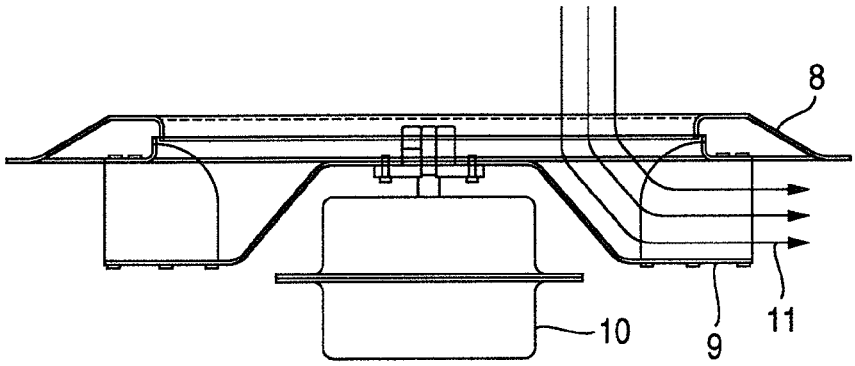
FIG.5 PRIOR ART
FIG. 5 is a view for explaining the form of a prior art blower system and the flowing of air.

FIG. 5 is a view showing an arrangement of a prior art blower system. As shown in FIG. 5, this blower system comprises a bell-mouth 8, an impeller 9 and a motor 10. In order to decrease thickness of the entire system, a section for accommodating the motor has been provided in the impeller in the prior art system. The section for accommodating the motor n has existed to occlude an intake port, and form a pass 11 of flow. This has caused an increase in resistance to the flow-in of air and a decrease in efficiency.

Figure 6:
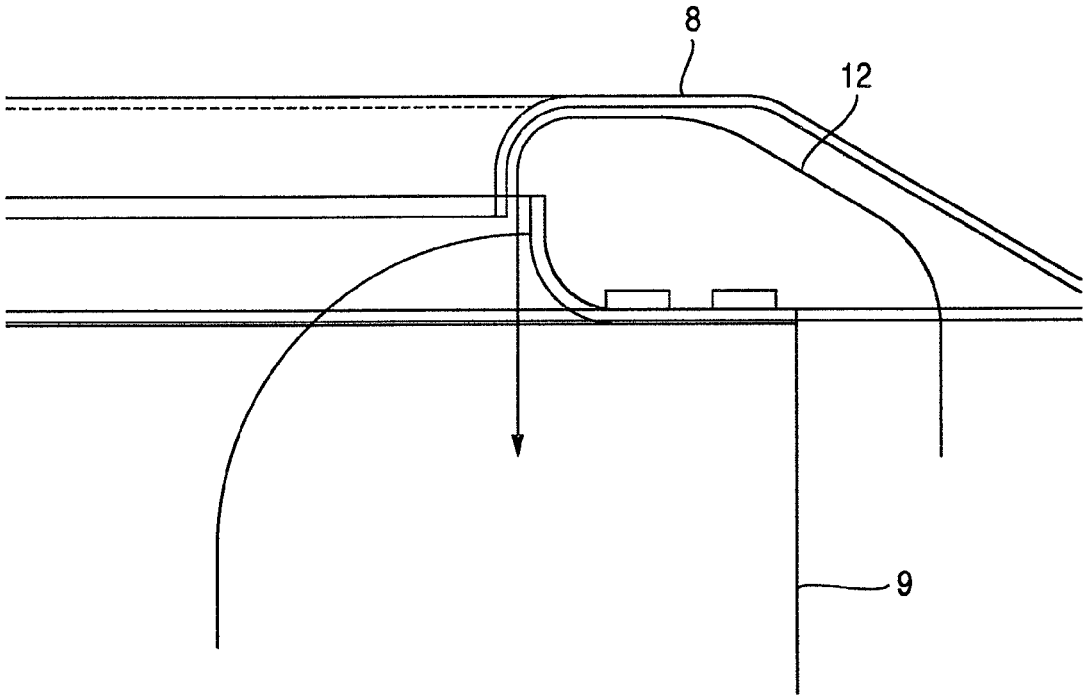
FIG.6 PRIOR ART
FIG. 6 is a view showing overlapped portions of a bell-mouth and an impeller of the prior art blower system.

FIG. 6 is an enlarged view showing overlapped portions of the bell-mouth 8 and the impeller 9 in the prior art blower system. In the overlapped portions, there is a leakage 12 from the inside of an equipment toward the intake port in the impeller, which is one of causes of the degradation of efficiency.

Figure 7:
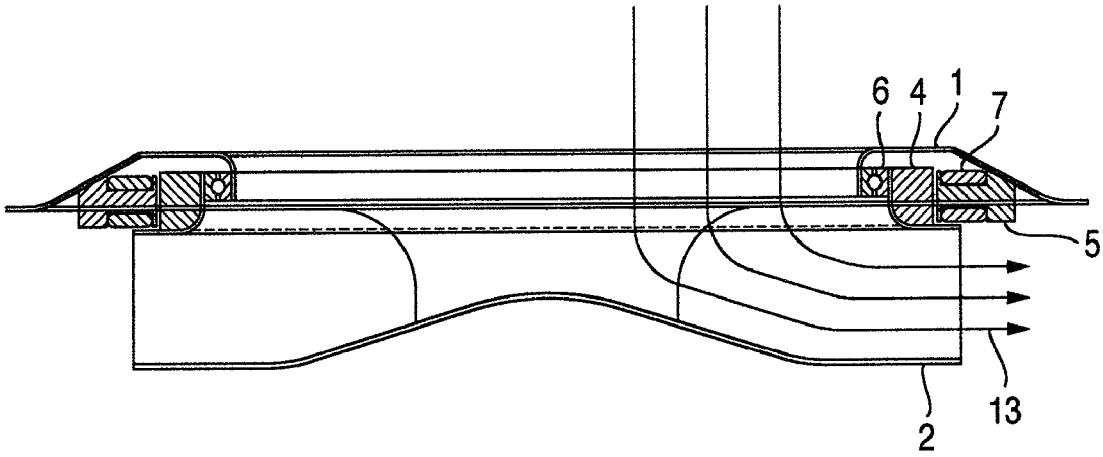
FIG. 7 is a view for explaining the form of the blower system and the flowing of air in the first embodiment.

FIG. 7 shows air flow path 13 in the blower system of the first embodiment. Since no sections accommodating a motor exists at the central portion of the impeller as shown in FIG. 7, there is no factor of increasing the resistance to the flow-in of air, and thus it is possible to improve the efficiency by about 4%, as compared with the prior art system.

Figure 8:
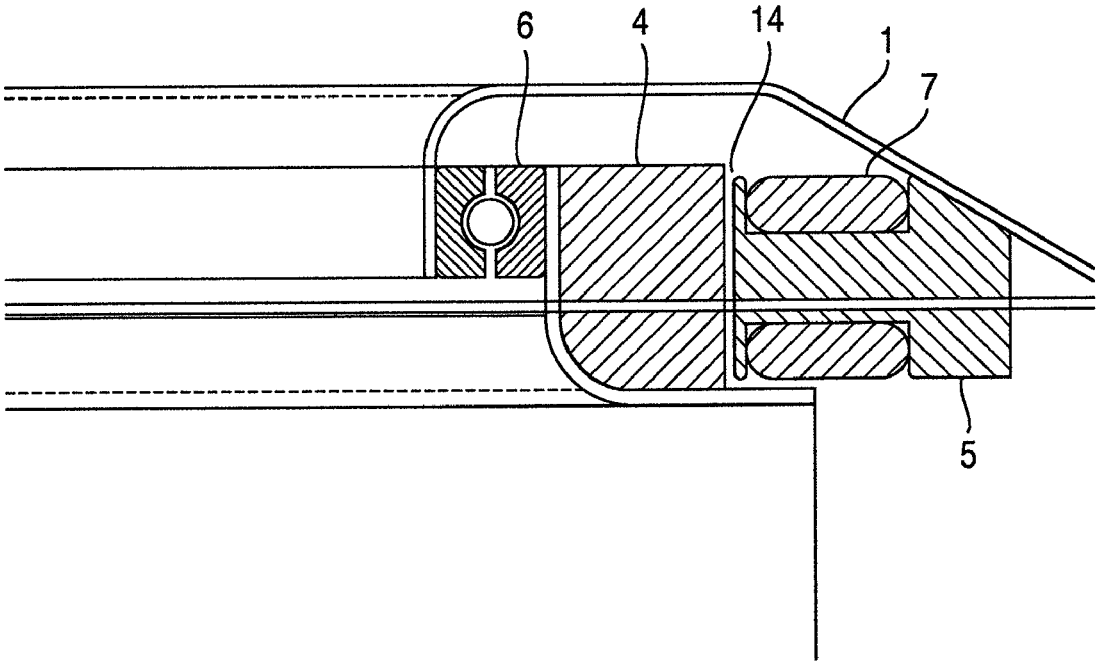
FIG. 8 is a view showing the overlapped portions of the bell-mouth and the impeller of the first embodiment.

FIG. 8 is an enlarged view showing overlapped portion of the bell-mouth 8 and the impeller 9 in the blower system of the first embodiment. As compared with the prior art system, a magnetic gap 14 between the rotor 4 and the stator 5 and a bearing 6 exist in a path of the leakage from the inside of the equipment toward the intake port in the impeller. In usual, the magnetic gap is very narrow in the order of several mm and extends a distance corresponding to the thickness of the motor, so that it has a structure in which air is difficult to leak. A bearing 6 also exists between the bell-mouth 1 and the impeller 2, and also has a structure in which air is difficult to leak. It is possible to use a sealed bearing as the bearing in order to have lesser leakage. Therefore, it is possible to construct the blower system which generates less amount of leakage and has a high efficiency, as compared with the prior art system.

In the prior art blower system, as shown in FIG. 5, the motor 10 exists at the central portion of the impeller 10, and air does not strike directly against the motor 10. Therefore, this blower system has disadvantageous structure for cooling the motor 10. In the blower system according to the present invention, however, the rotor 4 is fixed to the impeller 2, as shown in FIGS. 1 and 7, and the impeller has a role as a heat radiator. In case of FIG. 7, since the stator 5 is fixed to the bell-mouth 1, the bell-mouth has a role as a heat radiator.

Figure 9:
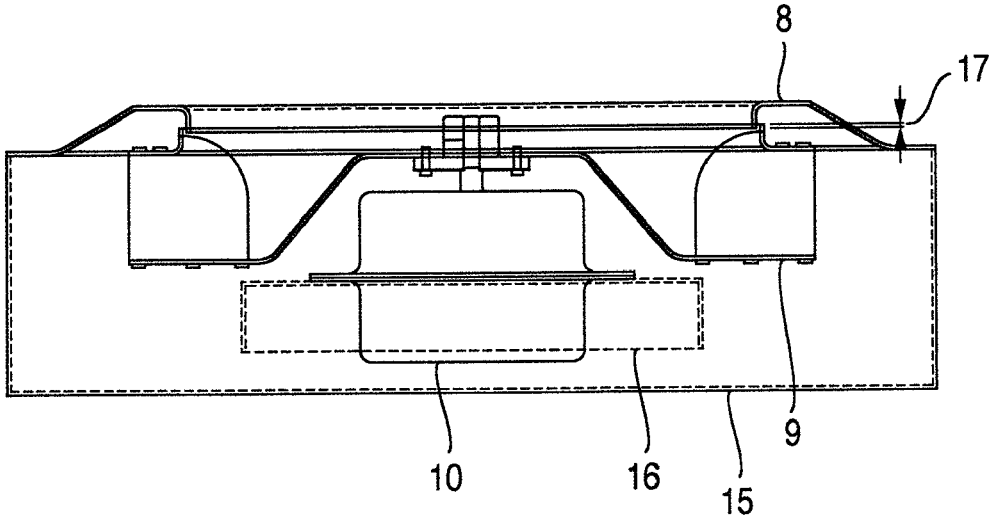
FIG.9 PRIOR ART
FIG. 9 is a view of an example of the prior art blower system incorporated in an equipment.

FIG. 9 shows the prior art blower system incorporated in an equipment. In the prior art structure, the bell-mouth 8 is fixed to an upper surface of a case 15, and the impeller 9 is fixed to the motor 10 which is fixed to a motor base 16. The motor base 16 is fixed to a side of the case 15. Therefore, the bell-mouth 8 and the impeller 9 are fixed at different points, and there is a possibility that they are in contact with each other depending on an assembled state of the system. Since an overlap 17 between the bell-mouth 8 and the impeller 9 largely influences the efficiency, the efficiency may be varied in some cases, depending to the assembled state.

Figure 10:
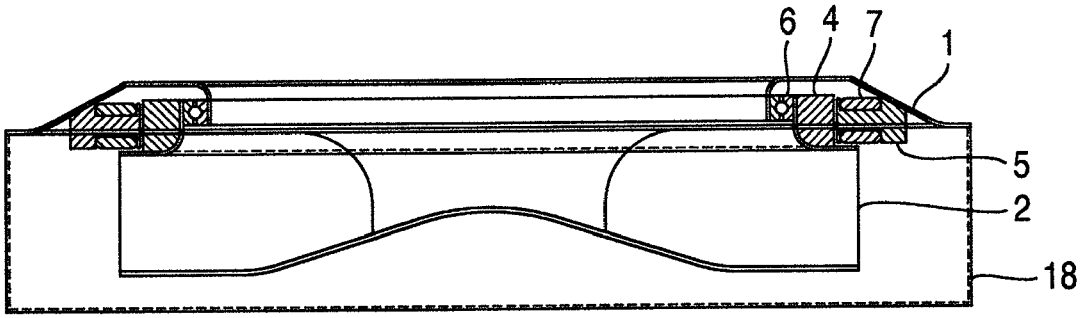
FIG. 10 is a view of an example of the blower system of the first embodiment of the invention incorporated in an equipment.

FIG. 10 shows the blower system of the first embodiment incorporated in an equipment. The bell-mouth 1, the bearings 6, the impeller 2 and the rotor 4 are fixed by the upper surface of the case 18, and the bell-mouth 1 and the stator 5 are also fixed. Thus, all of the components constituting the blower system are fixed from the upper surface of the case 18. Therefore, there is no possibility of a variation in efficiency and a contact due to the assembling of the equipment, and it is possible to provide stable characteristics and an easy assemblability.

Figure 11:
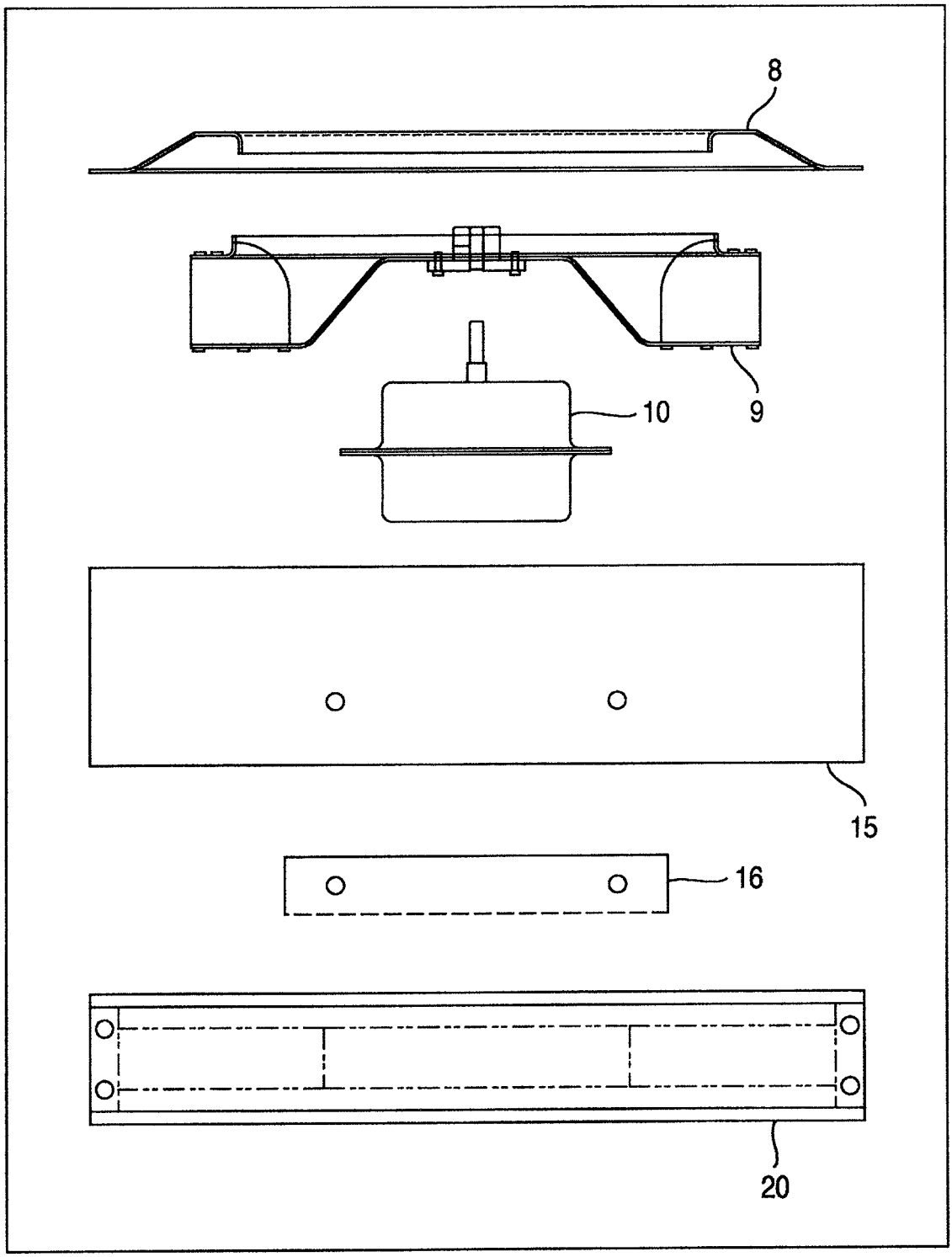
FIG.11 PRIOR ART
FIG. 11 is an exploded view of a fan filter unit with use of the prior art blower system shown in FIG. 5.

FIG. 11 is a partially exploded view of a fan filter unit with use of the prior art blower system. As shown in FIG. 11, a motor base 16 is inserted in a case 15 from an under side of the case. A motor 10 is mounted on the motor base 16, and an impeller 9 is fixed to the motor 10. A bell-mouth 8 is mounted on an upper face of the case 15. Then a filter 20 is attached, and thus the unit is assembled. This unit requires many parts, and a gap between the impeller 9 and the bell-mouth 8, which provides a large influence on a performance of the blower system, may vary according to assembling processes. Thus, a problem may arise in uniformity of quality of the unit.

Figure 12:
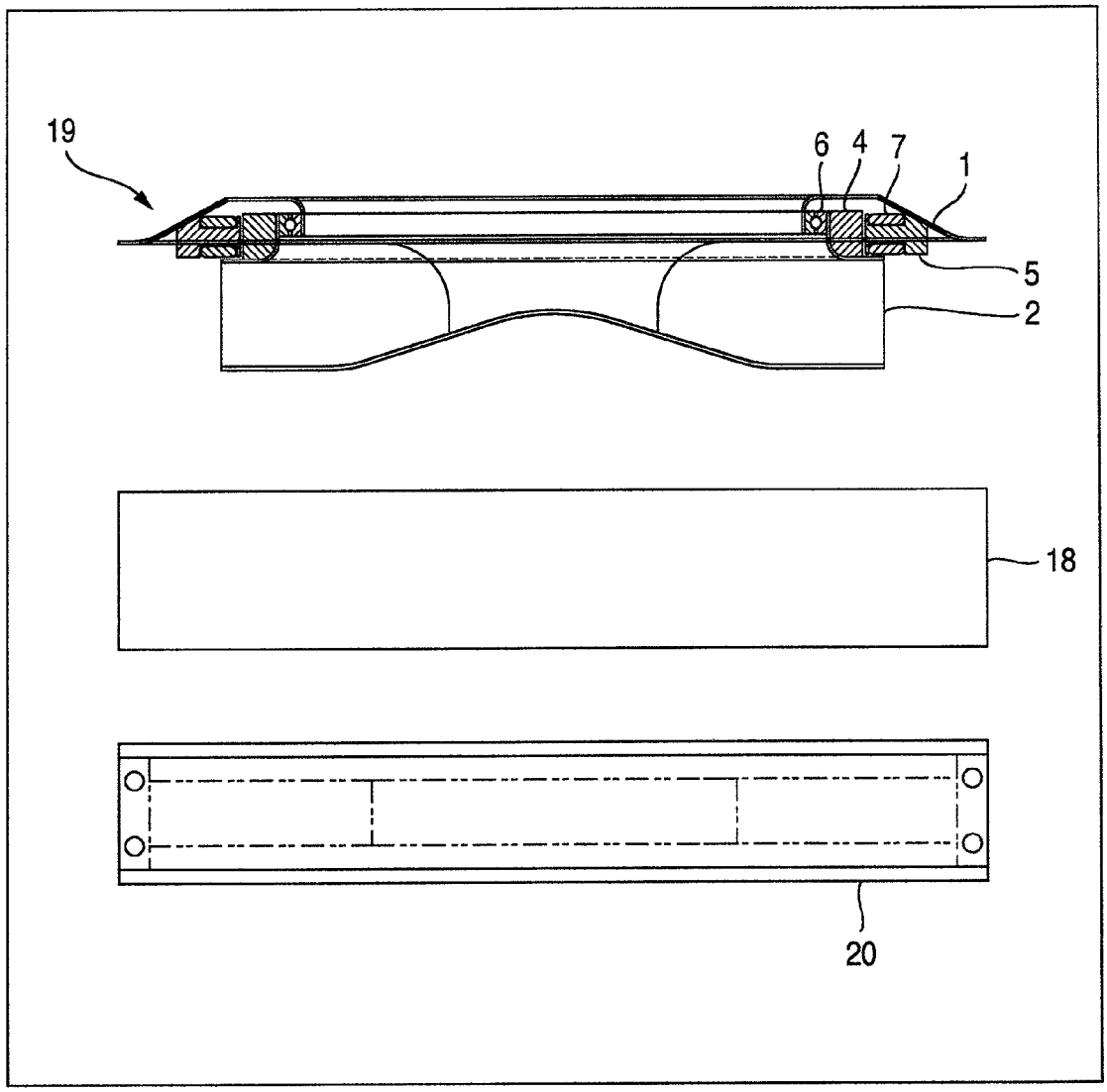
FIG. 12 is an exploded view of a fan filter unit with use of the blower system according to the invention shown in FIG. 1.

FIG. 12 is a partially exploded view of a fan filter unit with use of the blower system according to the invention. As shown in FIG. 12, an assembled fan motor 19 is mounted to a case from an upper side of the case, and a filter 20 is mounted to the case from an under side of the case, so that the fan filter unit is built. The fan motor 19 is assembled with a bearing 6, the impeller 2, the rotor 4 and the stator 5 attached to the bell-mouth 1. Such construction requires a few of parts. Furthermore, since the impeller 2 and the bell-mouth 1 are pre-assembled as a fan motor 19, a gap between the impeller 9 and the bell-mouth 8, which provides a large influence on a performance of the blower system, does not vary according to assembling processes, and a fan motor unit having an uniform quality can be provided. The fan filter unit is installed on a ceiling of a clean room, or on an upper portion of a safety cabinet or a clean work station.

According to the present invention, an optimal shape of a flow path can be formed without an increase in height of the entire blower system by disposing the thin motor at a lower portion of the impeller. In addition, a less amount of air leaks from between the impeller and the bell-mouth, so that it has a structure having a high efficiency and small size. Further, there are no sections accommodating a motor at the central portion of the impeller, so that resistance to the flow-in of air is decreased, noise is reduced and efficiency is increased.

In addition, according to the present invention, the gap between the impeller and the bell-mouth in the prior art is replaced by the gap between the rotor and the stator of the motor, whereby the gap is narrowed, and thus the amount of air leaked through the gap is decreased, leading to an increase in efficiency. The stator and the rotor of the motor can be thinned in a direction of a rotational axis by virtue of the larger diameters of the stator and the rotor, and the entire blower system can be reduced in size by thinning the motor region.

Furthermore, since the impeller is supported by the bell-mouth and the motor, the gap between the bell-mouth and the impeller is difficult to vary, thereby ensuring the efficiency stabilized. It is possible to construct the blower system in which the impeller, the bell-mouth and the motor are integrated, leading to an enhancement in assemblability.

Yet further, the rotor and the stator of the motor confront each other in parallel to the direction of the axis of rotation, thereby providing the stabilization of the motor.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A blower system comprising:

an impeller;

a motor configured to rotate the impeller, and having a rotor and a stator;

a bell-mouth configured to supply air to an intake port in the impeller; and a bearing disposed between the impeller and the bell-mouth;

wherein the rotor of the motor is fixed to the impeller, and the stator of the motor is fixed to the bell-mouth.

2. The blower system according to claim 1, wherein a gap between the impeller and the bell-mouth is composed of a gap between the rotor and the stator of the motor.

3. The blower system according to claim 1, wherein the rotor of the motor is annular and fixed to a peripheral portion of the impeller.

4. A blower system comprising:

an impeller;

a motor configured to rotate the impeller, and having a rotor and a stator; and a bell-mouth configured to supply air to an intake port in the impeller;

wherein the rotor of the motor is fixed to the impeller, and the stator of the motor is fixed to a fitting configured to mount a housing of the blower system or the blower system.

5. The blower system according to claim 4, wherein the rotor of the motor is annular and fixed to a peripheral portion of the impeller.

6. The blower system according to claim 4, wherein a bearing is disposed between the stator and the impeller.

7. The blower system according to claim 4, wherein the fitting is parallel to the bell-mouth.

8. A fan filter unit comprising a blower system comprising:

an impeller;

a motor configured to rotate the impeller, and having a rotor and a stator;

a bell-mouth configured to supply air to an intake port in the impeller; and a bearing disposed between the impeller and the bell-mouth;

wherein a fan motor is mounted to a case from an upper side thereof, the fan motor being assembled with a bearing, the impeller, the rotor and the stator attached to the bell-mouth, and wherein a filter is mounted to the case from an under side thereof.

* * * * *